US005794780A

United States Patent [19]

Parrella et al.

[11] Patent Number: 5,794,780

[45] Date of Patent: Aug. 18, 1998

[54] ERGONOMIC PACKAGE CONFIGURATION

[75] Inventors: Andrew M. Parrella, Middletown; Richard M. Jones, Loveland, both of Ohio

[73] Assignee: EM Industries, Incorporated, Hawthorne, N.Y.

[21] Appl. No.: 832,196

[22] Filed: Apr. 8, 1997

Related U.S. Application Data

[63] Continuation of Ser. No. 413,829, Mar. 30, 1995, abandoned.

[51] Int. Cl.[6] ..... B65D 25/30

[52] U.S. Cl. ..... 206/459.5; 229/117.16; 229/117.26

[58] Field of Search ..... 229/117.16, 117.17, 229/117.26; 206/459.5, 815; 220/752, 755, 756

[56] References Cited

U.S. PATENT DOCUMENTS

| | | | |
|---|---|---|---|
| 1,946,315 | 2/1934 | Ferguson | 229/15 |
| 2,069,997 | 2/1937 | Carr | 229/27 |
| 2,312,598 | 3/1943 | Sprague | 229/52 |
| 2,481,871 | 9/1949 | Potts | 229/52 |
| 3,160,326 | 12/1964 | Sturdevant et al. | 222/183 |
| 3,173,596 | 3/1965 | Aust et al. | 229/22 |
| 3,392,904 | 7/1968 | Wei | 229/33 |
| 3,863,829 | 2/1975 | Merrill | 229/16 D |
| 4,105,152 | 8/1978 | Elward | 229/23 BT |
| 4,974,773 | 12/1990 | Alexander et al. | 229/164 |
| 5,332,088 | 7/1994 | Schreiber | 229/117.16 X |
| 5,333,777 | 8/1994 | Roth | 229/117.16 |

FOREIGN PATENT DOCUMENTS

| | | |
|---|---|---|
| 1303181 | 7/1961 | France . |
| 87 10 326.5 | 11/1987 | Germany . |
| 96/08419 | 3/1996 | WIPO . |

OTHER PUBLICATIONS

PCT/EP96/01358 Written Opinion, Dec. 18, 1996.

*Primary Examiner*—Jacob K. Ackun

*Attorney, Agent, or Firm*—Millen, White, Zelano & Branigan, P.C.

[57] ABSTRACT

A carton has a first lateral side with a slot therein providing a hand hold disposed proximate the bottom of the carton and a second lateral side having a slot therein providing a second hand hold proximate the top of the carton so that the hand holds are substantially diagonally disposed with respect to one another. By so configuring the hand holds, a person is encouraged to bend their knees when lifting the carton as opposed to bending their back.

6 Claims, 2 Drawing Sheets

ERGONOMIC PACKAGE CONFIGURATION

This application is a continuation of application Ser. No. 08/413,829, filed Mar. 30, 1995 now abandoned.

FIELD OF THE INVENTION

The present invention is directed to an ergonomic package configuration. More particularly, the present invention is directed to an ergonomic package configuration in which hand holds are located on a package to facilitate lifting the package while minimizing the risk of injury.

BACKGROUND OF THE INVENTION

Every year, tens of thousands of back injuries debilitate workers and people in general in this country, resulting in tens of millions of dollars in lost productivity and wages, as well as considerable human misery. Many of these injuries occur when people lift cartons because they lift cartons by bending at the waist and arching their backs, rather than flexing their knees. This is because cartons are not configured to encourage people lifting the cartons to bend their knees. Rather, cartons are generally configured to encourage bending the back when lifting. Throughout American industry, in warehouses and factories and offices, as well as in doctor's offices, clinics and schools people are alerted to the danger of bending at the waist when lifting. This campaign is frustrated because items which are meant to be lifted are not ergonomically configured. Cartons having this difficulty are cartons such as that of DE-U-87 10 326.5 which has two hand hold slots at the top of side panels. WO 9608419A1 shows a container with a bottom and side handgrip but the container is not a carton.

SUMMARY OF THE INVENTION

It is a feature of the present invention to provide an ergonomic configuration for a package such as a carton wherein the configuration encourages the person lifting the carton to bend their knees instead of bending their back.

In view of this feature, and other features, the present invention is directed to a package having top and bottom surfaces, front and back surfaces and sides. In accordance with the present invention, the improvement comprises positioning a first hand hold at the first side of the package proximate the top surface and positioning a second hand hold at the side of the package proximate the bottom of the package, whereby a person lifting the package is encouraged to bend their knees when utilizing the first and second hand holds.

In accordance with a more specific aspect of the invention, the package is a box with lateral side panels and the hand holds are positioned at the lateral side panels.

In accordance with a still more specific aspect of the invention, the package is a carton and the hand holds are slots disposed in lateral side panels with one slot disposed proximate the top panel of the carton and the other slot disposed proximate a bottom panel of the carton.

In a still more specific aspect of the invention, the carton has front and back sides which are clearly marked with indicia and only a single slot hand hold is provided in each of the lateral side panels, both single slot hand holds being disposed substantially diagonally with respect to one another.

BRIEF DESCRIPTION OF THE DRAWINGS

Various other features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION

Figure 1:
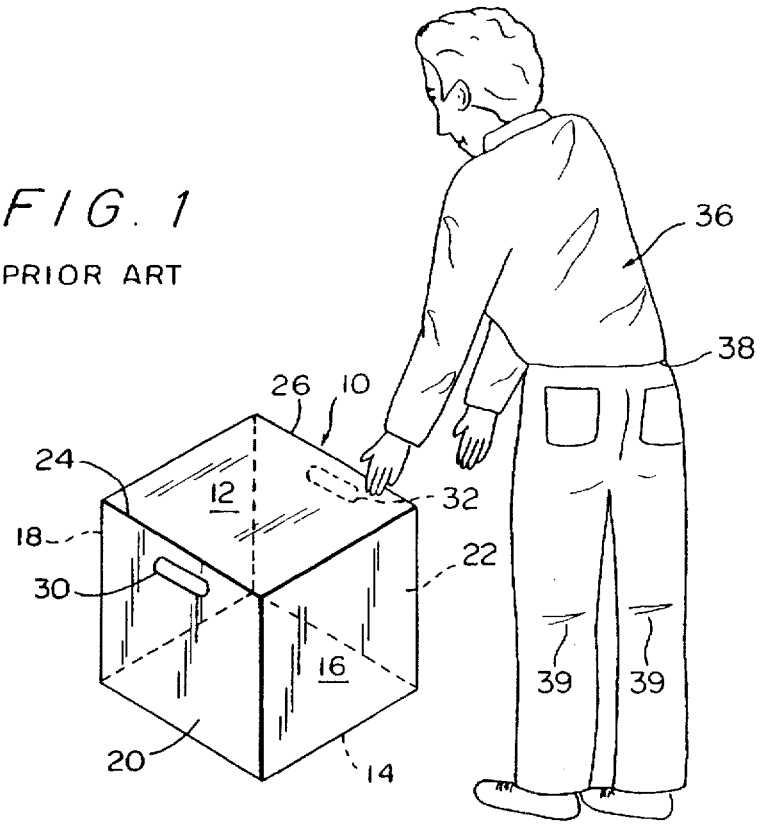
FIG. 1 PRIOR ART
FIG. 1 is a perspective view of a prior art carton with portions shown in phantom and a person bending over at the waist to lift the prior art carton.

Referring now to FIG. 1, there is shown a carton 10 configured in accordance with the principles of the prior art. The carton includes a top surface with closing flaps 13, a bottom panel 14, a back panel 16, a front panel 18, a first lateral side panel 20 and a second lateral side panel 22. Disposed proximate top edges 24 and 26 of the prior art carton 10 are slots 30 and 32 which provide hand holds or grips for lifting the carton.

Figure 2:
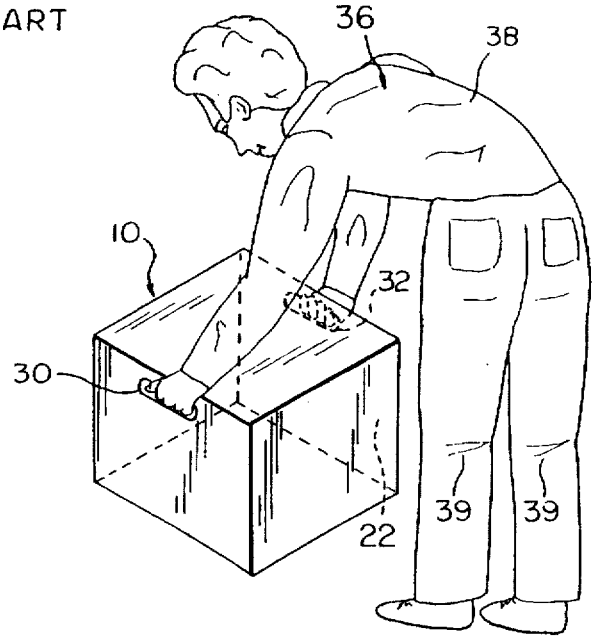
FIG. 2 PRIOR ART
FIG. 2 is a perspective view similar to FIG. 1 showing a person lifting the prior art carton.

With the carton 10 of FIGS. 1 and 2, the person 36 lifting the carton is encouraged to bend at his or her back 38 instead of bending at the knees 39 to lift the carton. This is a frequent cause of back injury which incapacitates tens of thousands of people a year, a number of whom are permanently incapacitated. Aside from the human injury caused by cartons such as the carton 10, millions of dollars in productivity are lost when workers are incapacitates and are unable to function.

Figure 3:
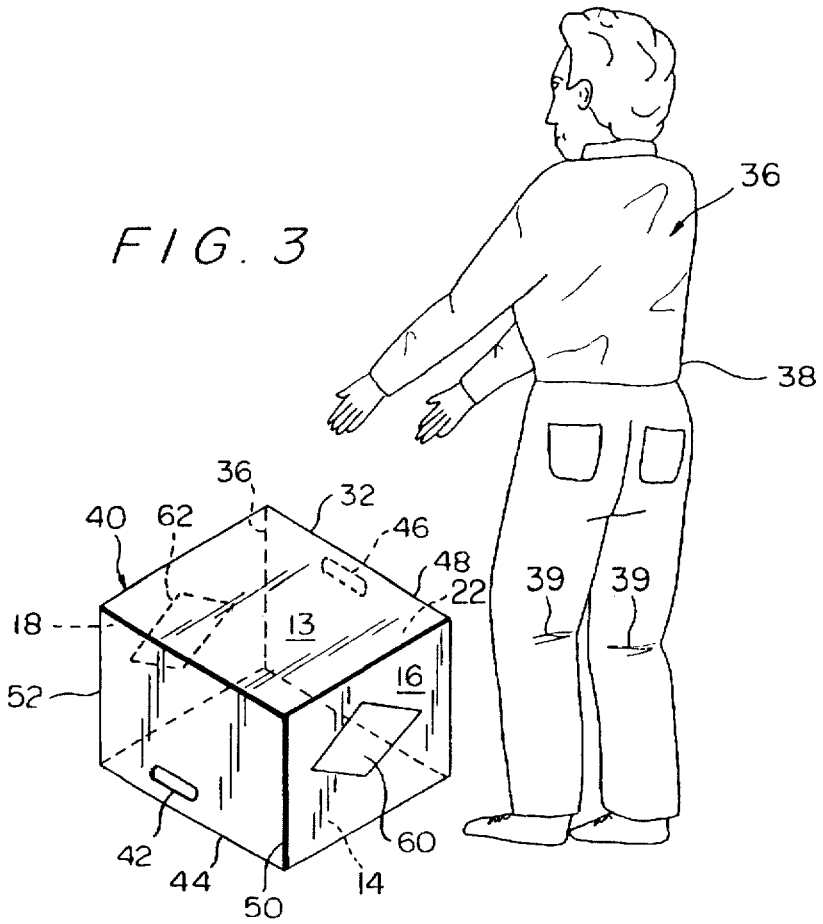
FIG. 3 is a perspective view partially in phantom of a carton configured in accordance with the principles of the instant invention with person approaching the carton to lift the carton.
Figure 4:
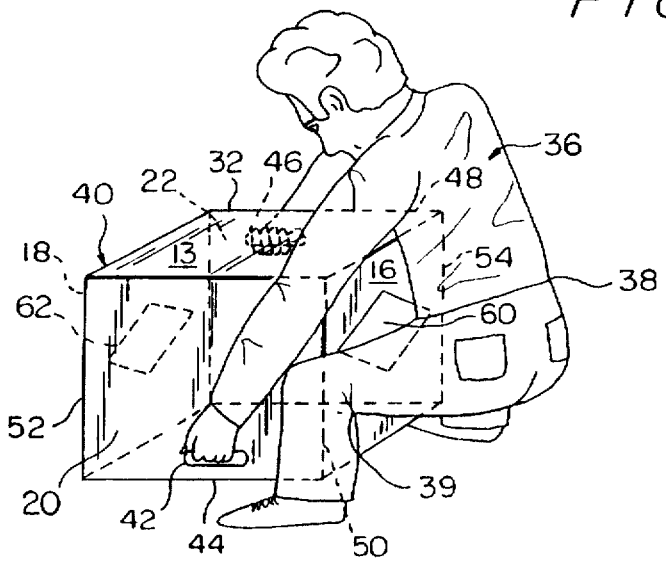
FIG. 4 is a view similar to FIG. 3 showing the person bending his knees lift the carton.

Referring now to FIGS. 3 and 4, where a carton 40 configured in accordance with the principles of the present invention is shown, it is seen that the carton 40 is substantially similar to the carton 10; however, the hand holds have been repositioned. In the carton 40, the first hand hold 42 is positioned proximate the lower edge 44 of the carton 40 and a second hand hold 46 is positioned proximate an upper edge 48. The edges 44 and 48 are diagonally opposed to one another and the slots 42 and 46 are in substantial diagonal opposition. In the illustrated embodiment, slot 42 is equidistant between the vertical edges 50 and 52 of the carton 40 and the slot 46 is equidistant between the vertical edges 54 and 56.

Preferably, the slots 42 and 46 are the only two slots providing hand holds in the carton 40. This encourages the person lifting the carton 40 to use those hand holds. In order to properly orient the carton to present the slots 42 and 46 to the person lifting the carton in a way that encourages the person to lift the carton properly. Indicia 60 and 62 are provided on the back and front panels 16 and 18, respectively, of the carton so that the cartons are oriented for proper lifting. The top panel 12, which may be defined by a pair of flaps 13, also has indicia thereon to indicate that the carton 40 should rest on bottom surface 14.

As is seen in FIGS. 3 and 4, the person 36 who now lifts the carton bends their knees 39 as opposed to bending their back 38. This is because, in order to reach the lower slot 42, the person 36 stoops and bends their knees which encourages the person to keep their back straight. Accordingly, when the carton 40 is lifted, the risk of injury is substantially reduced.

Applicants have configured a carton such as the carton 40 to carry four bottles of liquid reagent, the four bottles of reagent weighing approximately 65 pounds. By having only two hand holds diagonally disposed, it has been found that, when lifting boxes of this weight, employees have consistently flexed their knees 39 instead of their backs to lift the cartons 40.

Without further elaboration, it is believed that one skilled in the art can, using the preceding description, utilize the present invention to its fullest extent. The preferred specific embodiments are, therefore, to be construed as merely illustrative, and not limitative of the remainder of the disclosure in any way whatsoever.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. An ergonomic package configuration, wherein a carton has a top panel, a bottom panel, a back panel, a front panel and first and second lateral side panels with the lateral side panels intersecting the top and bottom panels along top and bottom edges, the improvement comprising:

a first substantially horizontal slot formed in the first lateral side panel proximate the bottom edge of the panel to provide a first hand hold and a second substantially horizontal slot configured in the second lateral side panel of the carton proximate the top edge thereof, diagonally disposed with respect to the bottom edge, said first slot and said second slot being only two slots in the carton whereby a person gripping the hand holds is encouraged to lift the carton by flexing his or her knees as opposed to lifting the carton by bending his or her back.

2. The ergonomic carton configuration of claim 1, wherein the slots extend parallel to the top and bottom edges and are spaced from the top and bottom edges.

3. The ergonomic carton configuration of claim 2, wherein the slots are located midway between the back and front panels of the carton.

4. The ergonomic carton configuration of claim 3 further including indicia on the back and front panels identifying the panels as front and back panels so that the carton is properly oriented with respect to the person prior to being lifted.

5. The ergonomic carton configuration of claim 1 further including indicia on the back and front panels identifying the panels as front and back panels so that the carton is properly oriented with respect to the person prior to being lifted.

6. The ergonomic carton configuration of claim 1, wherein the slots are located midway between the back and front panels of the carton.

* * * * *